US008495822B2

(12) United States Patent
Kim et al.

(10) Patent No.: US 8,495,822 B2
(45) Date of Patent: Jul. 30, 2013

(54) HEAT PUMP MODULE AND DRYING APPARATUS USING THE SAME

(75) Inventors: Na Eun Kim, Seoul (KR); Cheol Soo Ko, Seoul (KR); Young Min Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 439 days.

(21) Appl. No.: 12/700,190

(22) Filed: Feb. 4, 2010

(65) Prior Publication Data

US 2010/0192397 A1 Aug. 5, 2010

(30) Foreign Application Priority Data

Feb. 5, 2009 (KR) ..... 10-2009-0009374

(51) Int. Cl.

| | |
|---|---|
| ***F26B 21/06*** | (2006.01) |
| ***F26B 11/02*** | (2006.01) |
| ***F25B 13/00*** | (2006.01) |
| ***F25D 21/00*** | (2006.01) |

(52) U.S. Cl.
USPC ..... 34/73; 34/124; 62/150; 62/272

(58) Field of Classification Search
USPC ..... 34/73, 468, 201, 77, 124, 125; 62/324.5, 62/150, 272, 285, 288, 291
See application file for complete search history.

(56) References Cited

U.S. PATENT DOCUMENTS

| | | | | |
|---|---|---|---|---|
| 2,334,025 | A | 11/1943 | O'Neill | |
| 2,351,429 | A | 6/1944 | Huebsch | |
| 2,566,488 | A | 9/1951 | Gould | |
| 2,677,897 | A | 5/1954 | Herbster | |
| 2,755,072 | A * | 7/1956 | Kreuttner | 165/59 |
| 2,830,385 | A | 4/1958 | Smith | |
| 2,943,473 | A | 7/1960 | Worst | |
| 3,064,358 | A | 11/1962 | Giuffre | |
| 3,636,735 | A | 1/1972 | Borochaner | |
| 4,292,744 | A * | 10/1981 | Nabholz | 34/73 |
| 4,603,489 | A * | 8/1986 | Goldberg | 34/77 |
| 4,621,438 | A * | 11/1986 | Lanciaux | 34/77 |
| 5,174,467 | A * | 12/1992 | Sullivan | 220/571 |
| 5,343,632 | A * | 9/1994 | Dinh | 34/507 |
| 5,392,613 | A * | 2/1995 | Bolton et al. | 62/262 |

(Continued)

FOREIGN PATENT DOCUMENTS

| | | |
|---|---|---|
| CN | 1542208 A | 11/2004 |
| CN | 2680709 | 2/2005 |

(Continued)

OTHER PUBLICATIONS

European Search Report dated Nov. 16, 2012 issued in Application No. 10 73 8756.

(Continued)

*Primary Examiner* — Kenneth Rinehart
*Assistant Examiner* — Matthew D Sieger
(74) *Attorney, Agent, or Firm* — KED & Associates LLP

(57) ABSTRACT

A heat pump module and a drying apparatus having the same are provided. The heat pump module may include a housing, an evaporator provided in the housing that condenses humid air introduced into the housing via evaporation of a refrigerant, a condenser provided in the housing that heats the air having passed through the evaporator via condensation of the refrigerant, and at least one condensed water guide or remover provided in the housing that removes condensed water generated on a surface of the evaporator therefrom.

5 Claims, 11 Drawing Sheets

U.S. PATENT DOCUMENTS

| | | | | |
|---|---|---|---|---|
| 5,640,783 | A | 6/1997 | Schumaier | |
| 5,664,430 | A * | 9/1997 | Karman | 62/285 |
| 5,689,962 | A * | 11/1997 | Rafalovich | 62/90 |
| 5,697,227 | A * | 12/1997 | Bruce et al. | 62/285 |
| 5,732,562 | A * | 3/1998 | Moratalla | 62/94 |
| 5,732,565 | A * | 3/1998 | Ramakrishnan et al. | 62/298 |
| 5,787,721 | A * | 8/1998 | Fromm et al. | 62/285 |
| 5,806,207 | A | 9/1998 | Merrigan | 34/603 |
| 5,901,566 | A * | 5/1999 | Macosko et al. | 62/285 |
| 6,085,539 | A * | 7/2000 | Meyer | 62/285 |
| 6,098,310 | A | 8/2000 | Chen et al. | 34/475 |
| 6,471,739 | B2 * | 10/2002 | Eom | 55/471 |
| 6,701,739 | B2 * | 3/2004 | Morse | 62/277 |
| 7,055,262 | B2 | 6/2006 | Goldberg et al. | |
| 7,165,416 | B2 * | 1/2007 | Lee et al. | 62/406 |
| 7,168,274 | B2 | 1/2007 | Slutsky et al. | |
| 7,174,741 | B2 * | 2/2007 | Lee et al. | 62/412 |
| 7,213,407 | B2 * | 5/2007 | Hu | 62/324.5 |
| 7,263,852 | B2 * | 9/2007 | Bacchus | 62/305 |
| 7,284,388 | B2 * | 10/2007 | Yoshida | 62/285 |
| 7,325,333 | B2 * | 2/2008 | Tadano et al. | 34/604 |
| 7,409,776 | B2 * | 8/2008 | Ono et al. | 34/77 |
| 7,418,826 | B2 * | 9/2008 | Rios et al. | 62/285 |
| 7,430,877 | B2 * | 10/2008 | Davenport et al. | 62/285 |
| 7,469,486 | B2 * | 12/2008 | Tamura et al. | 34/77 |
| 7,694,434 | B2 | 4/2010 | Lee | |
| 7,866,061 | B2 * | 1/2011 | Tatsumi et al. | 34/595 |
| 7,908,766 | B2 * | 3/2011 | Ahn et al. | 34/595 |
| 7,950,245 | B2 * | 5/2011 | Lee et al. | 62/285 |
| 7,975,502 | B2 * | 7/2011 | Tamura et al. | 62/324.1 |
| 7,984,568 | B2 | 7/2011 | Dittmer et al. | |
| 8,037,707 | B2 * | 10/2011 | Lee et al. | 62/285 |
| 8,056,351 | B2 * | 11/2011 | Marciano et al. | 62/240 |
| 8,079,157 | B2 * | 12/2011 | Balerdi Azpilicueta et al. | 34/130 |
| 8,171,748 | B2 * | 5/2012 | Ooishi et al. | 62/263 |
| 2004/0079121 | A1 | 4/2004 | Yabuuchi et al. | 68/19.2 |
| 2004/0182100 | A1 * | 9/2004 | Lee et al. | 62/285 |
| 2005/0198851 | A1 | 9/2005 | Tomochika et al. | |
| 2005/0204755 | A1 * | 9/2005 | Nishiwaki et al. | 62/93 |
| 2006/0191289 | A1 * | 8/2006 | Bush et al. | 62/515 |
| 2006/0218976 | A1 | 10/2006 | Lee et al. | 68/15 |
| 2006/0263501 | A1 * | 11/2006 | Oghafua et al. | 426/523 |
| 2007/0095111 | A1 | 5/2007 | Watkins et al. | |
| 2007/0113574 | A1 * | 5/2007 | Davenport et al. | 62/285 |
| 2007/0134522 | A1 * | 6/2007 | Ko et al. | 429/13 |
| 2008/0000253 | A1 * | 1/2008 | Kim et al. | 62/291 |
| 2008/0223084 | A1 | 9/2008 | Kuwabara | |
| 2009/0013730 | A1 | 1/2009 | Woo et al. | |
| 2010/0077787 | A1 * | 4/2010 | Masuda et al. | 62/324.5 |
| 2010/0107703 | A1 | 5/2010 | Hisano et al. | |
| 2010/0180621 | A1 * | 7/2010 | Lee et al. | 62/291 |
| 2010/0326116 | A1 * | 12/2010 | Kwon | 62/291 |

FOREIGN PATENT DOCUMENTS

| | | | |
|---|---|---|---|
| CN | 1667177 | | 9/2005 |
| CN | 1695029 | | 11/2005 |
| CN | 1966844 | | 5/2007 |
| CN | 101122405 | | 2/2008 |
| CN | 101122410 | | 2/2008 |
| CN | 101135101 | | 3/2008 |
| CN | 101139791 | | 3/2008 |
| CN | 101153456 | | 4/2008 |
| CN | 101173478 | | 5/2008 |
| CN | 101187140 | | 5/2008 |
| CN | 101348989 | | 1/2009 |
| DE | 42 12 700 | A1 | 10/1993 |
| EP | 0 943 721 | A1 | 9/1999 |
| EP | 1 634 984 | A1 | 3/2006 |
| EP | 1 726 703 | | 11/2006 |
| GB | 2 289 752 | A | 11/1995 |
| JP | 59-085694 | | 5/1984 |
| JP | 2001-212599 | | 8/1989 |
| JP | 02-029296 | | 1/1990 |
| JP | 05-049795 | | 3/1993 |
| JP | 2001-198398 | | 7/2001 |
| JP | 2006-110394 | | 4/2006 |
| JP | 2006-345919 | | 12/2006 |
| JP | 2007-127326 | | 5/2007 |
| JP | 2007-175528 | | 7/2007 |
| JP | 2007-330439 | A | 12/2007 |
| JP | 2007-330571 | | 12/2007 |
| JP | 2008-000226 | A | 1/2008 |
| JP | 2008-006127 | | 1/2008 |
| JP | 2008-48830 | | 3/2008 |
| KR | 10-2006-0052284 | | 5/2006 |
| KR | 10-2007-0082377 | | 8/2007 |
| KR | 10-2008-0056007 | | 6/2008 |
| WO | WO 2005/090669 | | 9/2005 |
| WO | WO 2006/009364 | | 1/2006 |
| WO | WO 2006/097901 | A2 | 9/2006 |

OTHER PUBLICATIONS

Chinese Office Action dated Nov. 26, 2012 issued in Application No. 201080005766.9 (with English translation).

U.S. Office Action issued in U.S. Appl. No. 12/700,176 dated Jul. 2, 2012.

International Search Report and Written Opinion dated Aug. 2, 2010 issued in Application No. PCT/KR2010/000867.

International Search Report and Written Opinion dated Oct. 11, 2010 (Application No. PCT/KR2010/001317).

International Search Report and Written Opinion dated Oct. 19, 2010 (Application No. PCT/KR2010/000713).

Chinese Office Action dated Aug. 13, 2012 (5041.X) with translation.

Chinese Office Action dated Aug. 13, 2012 (4986.X) with translation.

Chinese Office Action dated Aug. 14, 2012 (5040.5) with translation.

Chinese Office Action dated Aug. 28, 2012 (5042.4) with translation.

U.S. Office Action issued in U.S. Appl. No. 12/709,816 dated Oct. 22, 2012.

International Search Report and Written Opinion dated Apr. 13, 2010 issued in Application No. PCT/KR2010/000487.

U.S. Office Action issued in U.S. Appl. No. 12/709,751 dated Apr. 5, 2013.

* cited by examiner

HEAT PUMP MODULE AND DRYING APPARATUS USING THE SAME

This application claims the benefit of Korean Patent Application No. 10-2009-0009374, filed on Feb. 5, 2009, which is hereby incorporated by reference as if fully set forth herein.

BACKGROUND

1. Field

A heat pump module and a drying apparatus using the same are disclosed herein.

2. Background

Heat pump modules and drying apparatuses are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to the embodiments, examples of which are illustrated in the accompanying drawings. So long as being not specially defined, all terms in the context of describing the embodiments may be commonly understood by those skilled in the art to have the same meaning as the general meaning, or may be dedicatedly defined in the specification when having a specific meaning conflicting with the general meaning thereof.

Wherever possible, like reference numbers have been used throughout the drawings to refer to the same or like parts. It will be understood that the structure and operation of the embodiments will be described only by way of example and therefore the technical scope is not limited to the embodiments.

Generally, a drying apparatus is a home appliance that conventionally dries washed laundry or other objects to be dried, using high temperature air. The drying apparatus may include a drying tub (conventionally, referred to as a drum) in which an object to be dried is received, a drive source that rotates the drum, a heating device that creates high temperature air by heating air introduced into the drum, and a blower that sucks or discharges the air into or from the drum.

Drying apparatuses may be classified, according to a type of air heating method, that is, according to a type of heating device, such as an electric drying device or a gas drying device. The electric drying device heats air using electric resistance heat generated by an electric heater. The gas drying apparatus heats air using gas combustion heat generated by a gas burner.

Drying apparatuses may also be classified into, for example, a condensing (circulating) drying apparatus or a blowing drying apparatus. In the blowing drying apparatus, highly humid air inside a drum, generated via heat exchange with an object to be dried, may be directly discharged out of the drying apparatus. In the condensing drying apparatus, highly humid air, generated via heat exchange with an object to be dried, may be circulated within a drum rather than being discharged out of the drying apparatus, drying the object via dehumidification and heating of the circulating air. In the case of the condensing drying apparatus, when the highly humid air generated via heat exchange with the object to be dried is condensed, moisture contained in the highly humid air is discharged as condensed water, and therefore, the condensing drying apparatus may need a device for removal of the condensed water.

Embodiments disclosed herein show a heat pump module and drying apparatus having the same, as examples. However, the invention may be employed in any home appliance or device in which the removal of condensed water or fluid may be advantageous.

Figure 1:
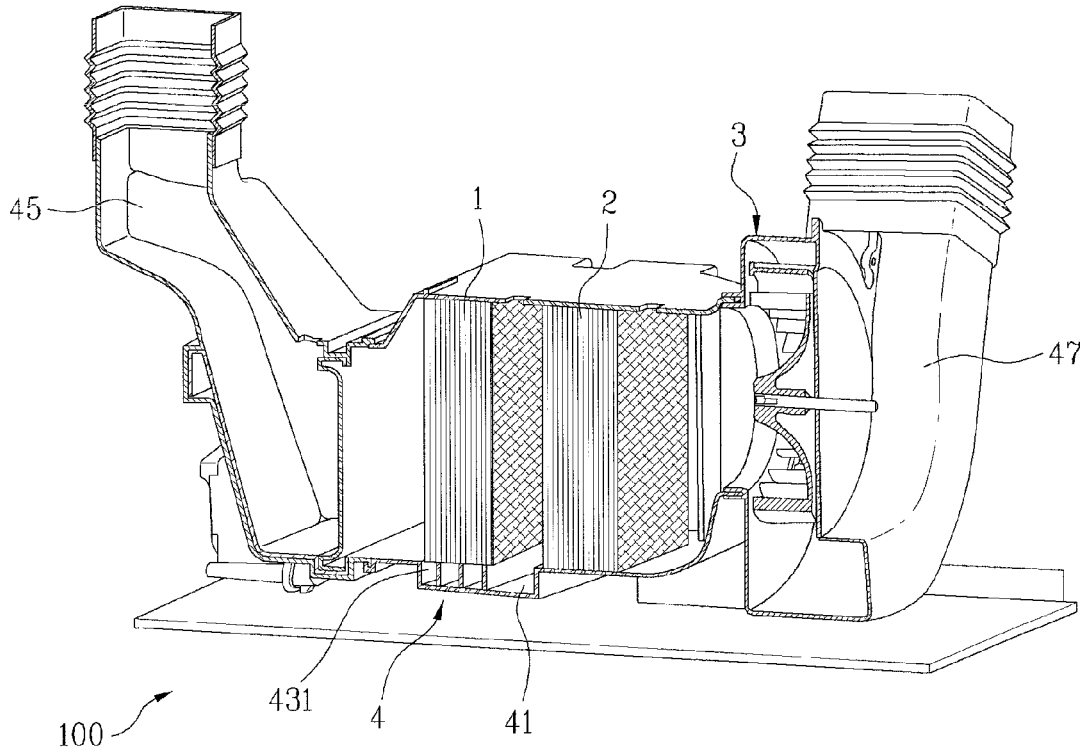
FIG. 1 is a perspective view of a heat pump module according to an embodiment.

FIG. 1 is a perspective view of a heat pump module according to an embodiment. The heat pump module 100 of FIG. 1 may include an evaporator 1, a condenser 2, a fan 3, and a housing 4.

The evaporator 1 may serve to evaporate refrigerant, so as to condense air flowing in an interior of the heat pump module 100. When the refrigerant is evaporated in the evaporator 1, the refrigerant may absorb heat from the air flowing in the interior of the heat pump module 100, thereby acting to condense the air passing through the heat pump module 100. The evaporator 1 may be positioned at an entrance side of the housing 4, through which air may be introduced into the heat pump module 100.

The condenser 2 may serve to condense the refrigerant, so as to heat the air flowing in the interior of the heat pump module 100. When the refrigerant is condensed in the condenser 2, the refrigerant emits heat. The air passing through the condenser 2 may be heated by absorbing the heat emitted from the refrigerant while flowing in the interior of the heat pump module 100. The condenser 2 may be positioned to heat the air that flows in the interior of the heat pump module 100 after having passed through the evaporator 1, and thus, may be positioned at an exit side of the housing 4.

The fan 3 may serve to forcibly flow the air into the heat pump module 100 and may be installed in the housing 4. The housing 4 may be configured to maintain the evaporator 1, the condenser 2, and the fan 3 at or in fixed positions, and may provide an air path to introduce air into the heat pump module 100 and discharge air, having undergone heat exchange with the refrigerant, from the heat pump module 100.

The housing 4 may be connected, at one side thereof, to or may include an inlet duct 45 for introduction of air thereto, and may be connected, at another side thereof, to or may include an outlet duct 47 for discharge of heat-exchanged air. The evaporator 1 and the condenser 2 may be sequentially arranged following the inlet duct 45. In addition, the evaporator 1 and the condenser 2 may be spaced apart from each other by a predetermined distance, enabling condensation and heating of the air passing through the housing 4.

The fan 3 may be arranged between the condenser 2 and the outlet duct 47. This arrangement may facilitate introduction/discharge of air through the inlet duct 45 and the outlet duct 47.

In the heat pump module 100 having the above described configuration, when air is introduced through one side of the housing 4 and undergoes heat exchange in the evaporator 1, moisture may be removed from the air introduced into the housing 4, forming condensed water on a surface of the evaporator 1. The condensed water formed on the surface of the evaporator 1 may disadvantageously deteriorate heat exchange efficiency of the air introduced into the housing 4, and also, may remain on a bottom surface of the housing 4. In particular, if the heat pump module 100 is received in a hermetically sealed space of a drying apparatus, the condensed water remaining on the bottom surface of the housing 4 may cause undesirable sanitary problems. Therefore, removal of the condensed water is very important in a home appliance, such as a drying apparatus, including an evaporator mounted in a hermetically sealed space thereof. Although one might consider providing the housing 4 with a drain configuration (for example, a drain hole), the condensed water formed on a lower surface of the evaporator 1 may have difficulty separating from the lower surface of the evaporator 1 due to surface tension thereof.

To solve the above described problem, the housing 4 provided in the heat pump module 100 according to an embodiment may include a condensed water reservoir 41 and a condensed water remover in the form of a condensed water guide 431. Hereinafter, the condensed water reservoir 41 and the condensed water guide 431 of the housing 4 according to embodiments will be described in detail with reference to FIGS. 2 to 4.

Figure 2:
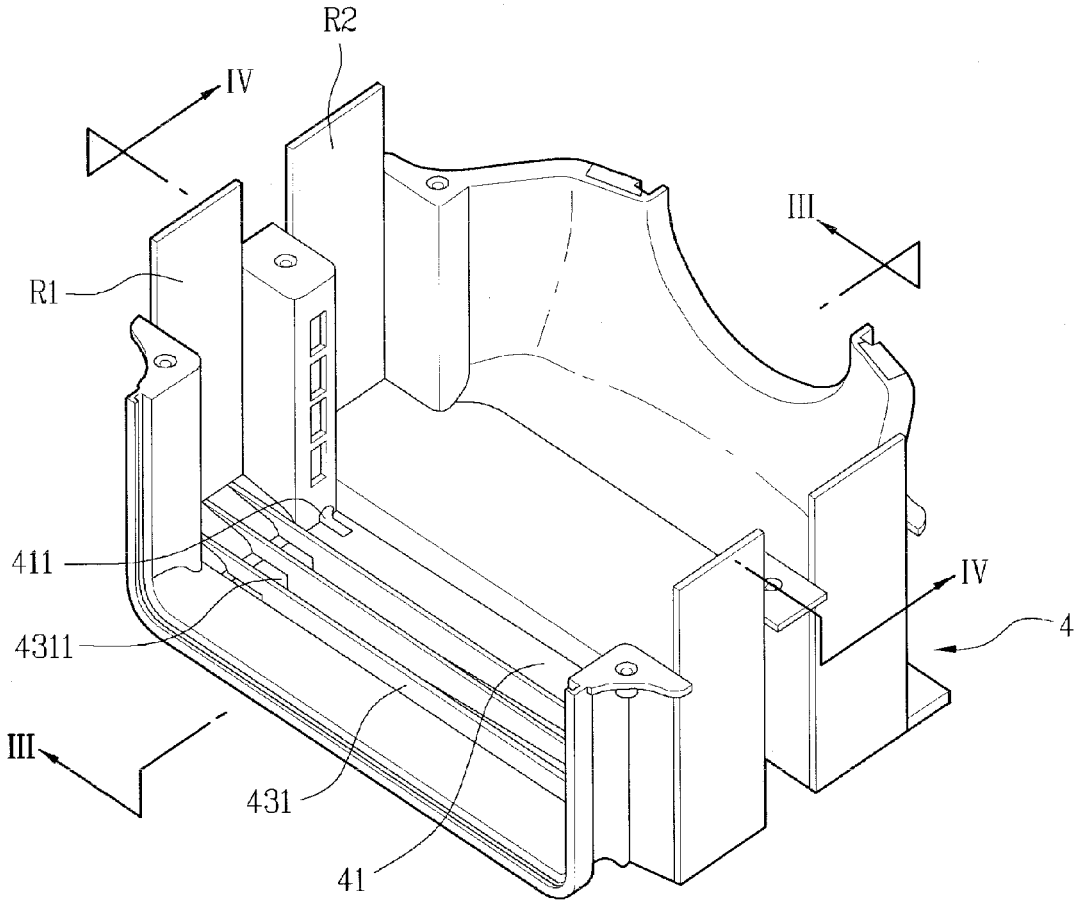
FIG. 2 is a perspective view of a housing according to an embodiment.
Figure 3:
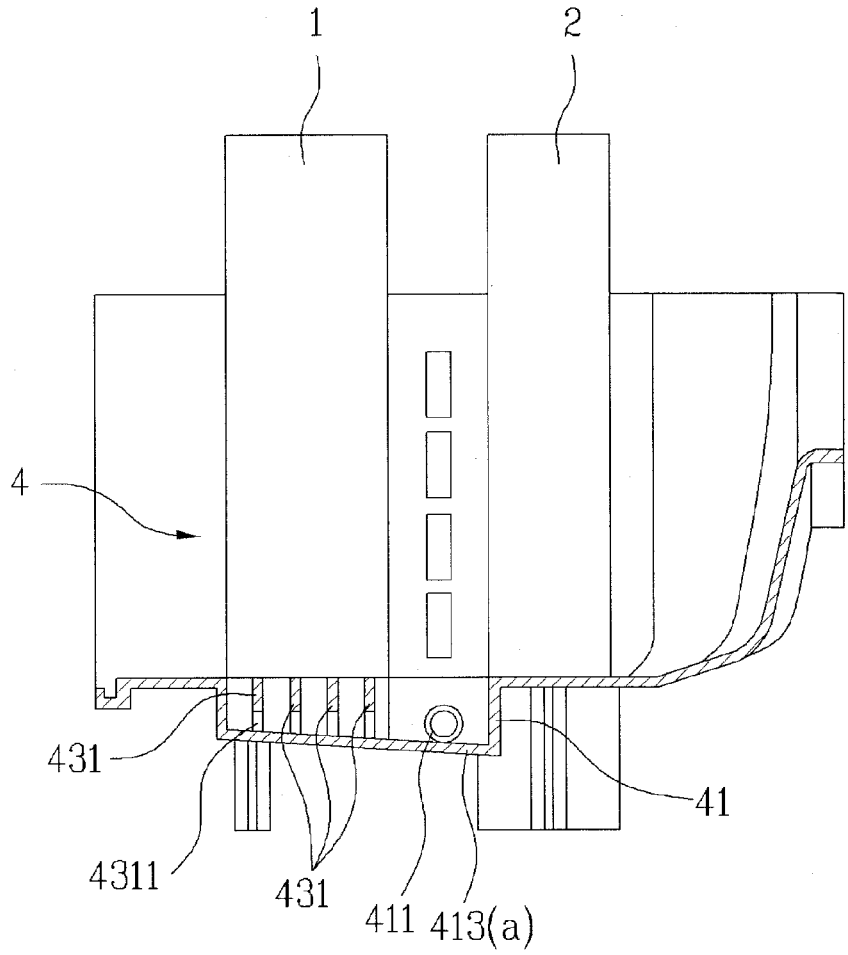
FIG. 3 is a sectional view taken along the line III-III of FIG. 2.
Figure 4:
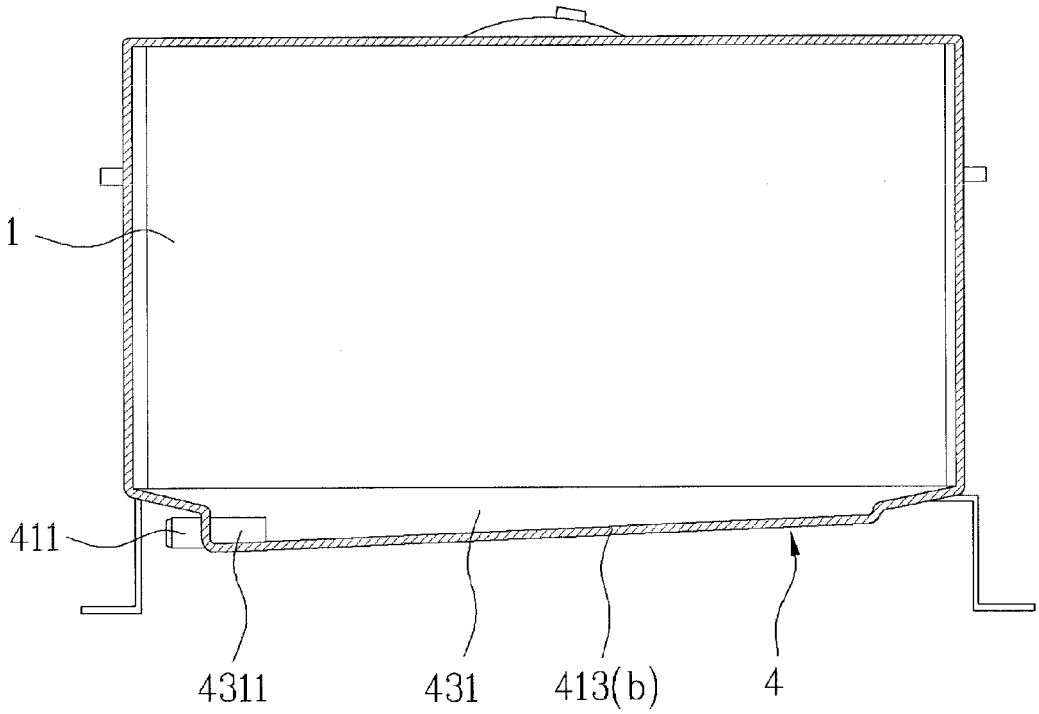
FIG. 4 is a sectional view taken along the line IV-IV of FIG. 2.

FIG. 2 is a perspective view of a housing according to an embodiment. FIG. 3 is a sectional view taken along the line III-III of FIG. 2, and FIG. 4 is a sectional view taken along the line IV-IV of FIG. 2.

Referring to FIG. 3, the condensed water reservoir 41 of the housing 4 may be indented or extend from the lower surface of the evaporator 1 and may be configured to store the condensed water formed on the evaporator 1. The condensed water reservoir 41 may be formed only at the lower surface of the evaporator 1. This is because the evaporator 1 is where the air flowing through the interior of the heat pump module 100 is dehumidified, causing generation of condensed water.

The housing 4 may further include a drain part 411 formed at one side of the condensed water reservoir 41 to discharge the condensed water collected from the evaporator 1. Thereby, the condensed water stored in the condensed water reservoir 41 may be discharged out of the housing 4.

A bottom surface of the condensed water reservoir 41 may be inclined or sloped downward toward the drain part 411 by a predetermined angle. This serves to easily discharge the condensed water collected in the condensed water reservoir 41 out of the housing 4.

A slope defined at the condensed water reservoir 41 may be configured as shown in FIG. 3, such that a slope 413*a* extends in a longitudinal direction of the housing 4, or may be configured as shown in FIG. 4, such that a slope 413*b* extends in a transversal direction of the housing 4. Alternatively, slopes may extend in the longitudinal direction and the transversal direction of the housing 4. When the slope 413*a* and/or 413*b* are/is provided, for drainage of the condensed water, the drain part 411 may be located at a lowest position of the slope 413*a* or 413*b*.

Hereinafter, the condensed water remover in the form of the condensed water guide 431 will be described with reference to FIGS. 2 and 3. Referring to FIG. 2, the condensed water guide 431 may extend vertically between the bottom surface of the condensed water reservoir 41 and the lower surface of the evaporator 1. Further, the condensed water guide 431 may contact, at one side thereof, the bottom surface of the evaporator 1, and at the other side thereof, the bottom surface of the condensed water reservoir 41.

If one side of the condensed water guide 431 is disposed adjacent to or contacts the lower surface of the evaporator 1, the removal of the condensed water via the condensed water guide 431 may be facilitated when the condensed water forms on the surface of the evaporator 1 and moves to the lower surface of the evaporator 1. Also, since the other side of the condensed water guide 431 may be disposed adjacent to or contact the bottom surface of the condensed water reservoir 41, the condensed water moved to the condensed water guide 431 may move to the bottom surface of the condensed water reservoir 41 via gravity.

A plurality of condensed water guides 431 may be provided, so as to serve not only to remove the condensed water formed on the evaporator 1, but also to function as supports for the evaporator 1. The condensed water guide(s) 431 may be provided with a communication part 4311, to allow the condensed water collected on the bottom surface of the condensed water reservoir 41 to be moved to the drain part 411 along the slope 413*a*. Although FIGS. 2 to 4 illustrate a communication part in the form of a hole, the condensed water guide(s) 431 may be spaced apart from a sidewall of the condensed water reservoir 41 by a predetermined distance to define a communication gap therebetween.

The condenser 2 may be separated from the condensed water guide(s) 431 and the condensed water reservoir 41 disposed adjacent to the evaporator 1. That is, the condenser 2 may serve to heat the air flowing in the interior of the heat pump module 100, and therefore, may have deterioration in efficiency if the condenser 2 comes into contact with the condensed water removed from the evaporator 1.

The housing 4 according to an embodiment, as shown in FIG. 2, may include fitting portions R1 and R2 that maintain the evaporator 1 and the condenser 2 at fixed positions, respectively. This may improve assembly efficiency of the heat pump module 100.

Hereinafter, operational relationships of the above described elements of the heat pump module 100 according to this embodiment will be described.

Referring to FIG. 1, if the heat pump module 100 is operated for the purpose of drying air, the fan 3 may be operated, causing air to be introduced into the housing 4 through the inlet duct 45. When the air introduced into the housing 4 undergoes heat exchange in the evaporator 1, the air may be deprived of moisture, causing condensed water to be formed on the surface of the evaporator 1. The condensed water formed on the surface of the evaporator 1 may be moved to the bottom surface of the housing 4 along the condensed water guide(s) 431, which may be disposed adjacent to or in contact the lower surface of the evaporator 1, thereby being collected in the condensed water reservoir 41. In this case, the condensed water stored in the condensed water reservoir 41 may be moved toward the drain part 411 of the housing 4 along the slope 413*b* of FIG. 4.

Alternatively, the condensed water stored in the condensed water reservoir 41 may be moved toward the drain part 411 along the slope 413*a* of FIG. 3 by passing through the communication part 4311 formed in the condensed water guide 431. In this way, the condensed water collected in the condensed water reservoir 41 of the housing 4 may be discharged out of the housing 4 through the drain part 411.

As will be appreciated from FIG. 1, under operation of the fan 3, the heat-exchanged air having passed through the evaporator 1 may be introduced into the condenser 2, and then, may be discharged out of the heat pump module 100 through the outlet duct 47 after being heated.

Figure 5:
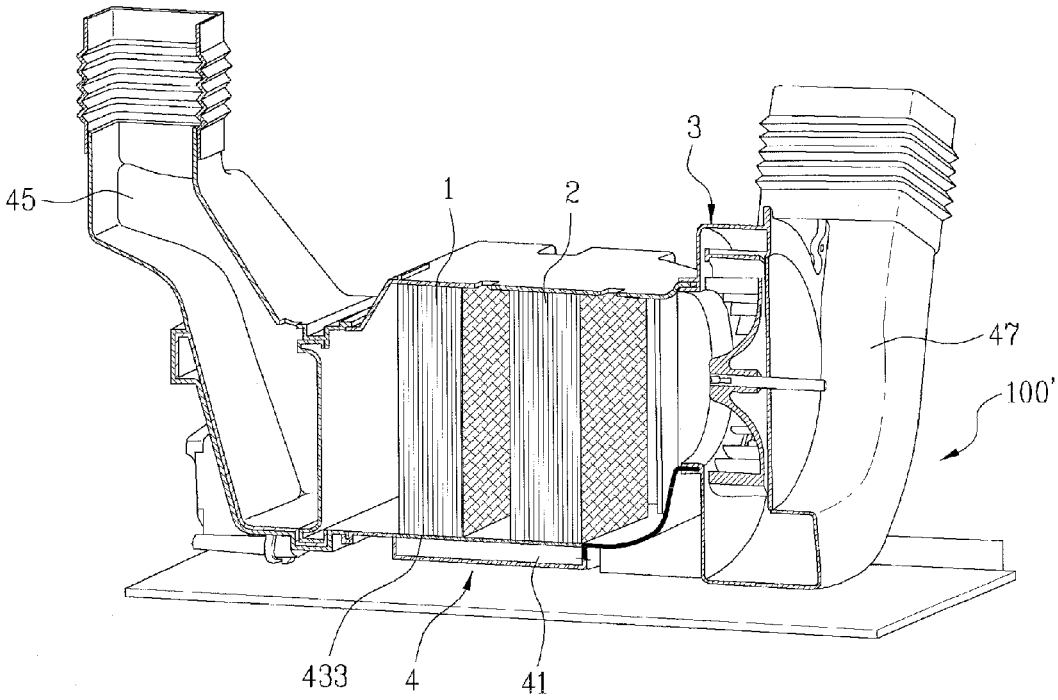
FIG. 5 is a perspective view of a heat pump module according to another embodiment.

FIG. 5 is a perspective view of a heat pump module according to another embodiment. The heat pump module 100' according to this embodiment may include the evaporator 1, the condenser 2, the fan 3, and the housing 4. The evaporator 1, the condenser 2, and the fan 3 may have the same configurations as the previously described embodiment of FIG. 1, and thus, a detailed description thereof has been omitted. Hereinafter, only a configuration of the housing 4 different from the previously described embodiment of FIGS. 1-4 will be described.

Figure 6:
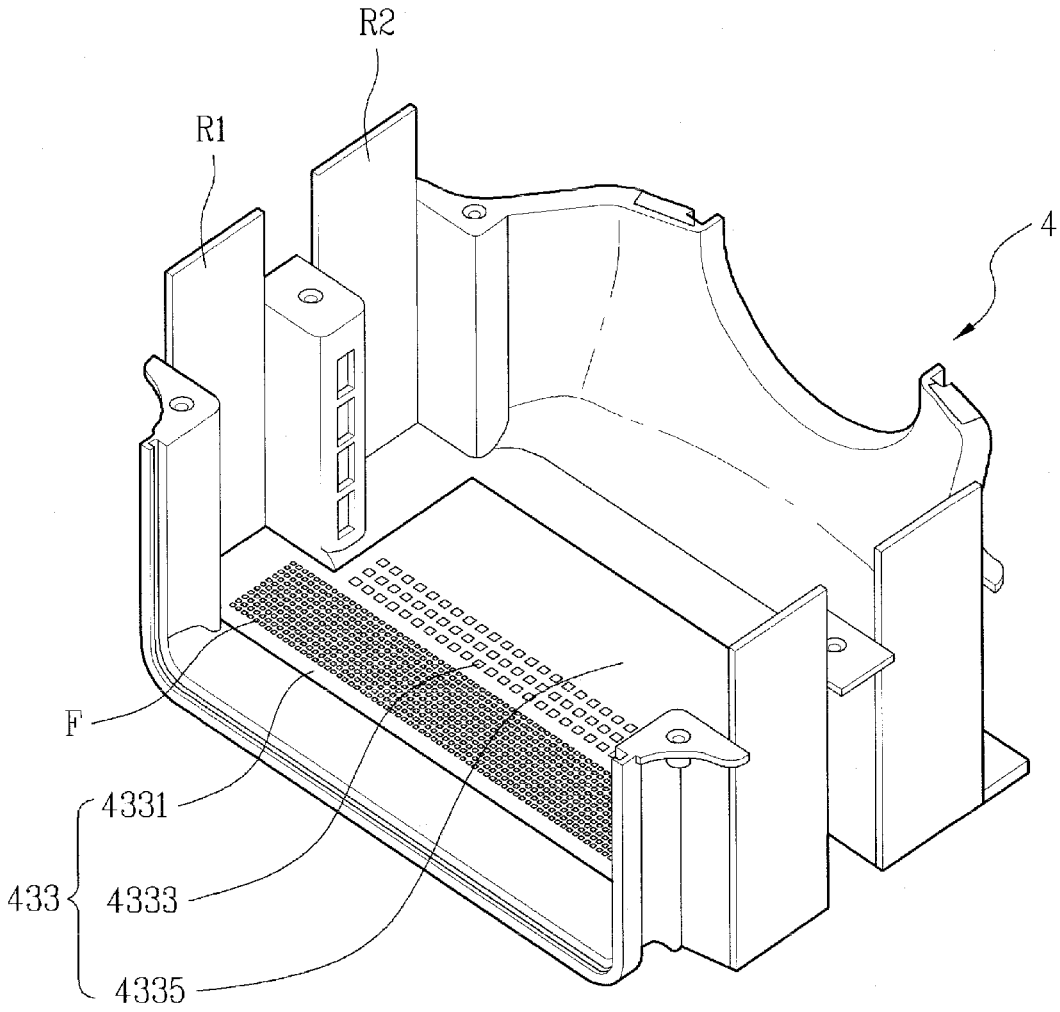
FIG. 6 is a perspective view of a housing according to another embodiment.

FIG. 6 is a perspective view of a housing 4 according to another embodiment. The housing 4 may be configured to maintain the evaporator 1, the condenser 2, and the fan 3 at fixed positions, and may provide an air path to introduce air into the heat pump module 100' and discharge air, having undergone heat exchange with the refrigerant, from the heat pump module 100'. The housing 4 may be connected, at one side thereof, to or may include the inlet duct 45 for introduction of air, and may be connected at the other side thereof, to or may include the outlet duct 47 for discharge of the heat-exchanged air.

The evaporator 1 and the condenser 2 may be sequentially arranged following the inlet duct 45. In addition, the evaporator 1 and the condenser 2 may be spaced apart from each other by a predetermined distance, enabling condensation and heating of the air passing through the housing 4.

The fan 3 may be arranged between the condenser 2 and the outlet duct 47. This arrangement may facilitate introduction/discharge of air through the inlet duct 45 and the outlet duct 47.

In the heat pump module 100' having the above described configuration, when air is introduced through one side of the housing 4 and undergoes heat exchange in the evaporator 1, moisture may be removed from the air introduced into the housing 4, forming condensed water on the surface of the evaporator 1. The condensed water formed on the surface of the evaporator 1 may disadvantageously deteriorate heat exchange efficiency of the air introduced into the housing 4 and may remain on the bottom surface of the housing 4. Although one might consider providing the housing 4 with a drain part for drainage of the condensed water, it may be difficult to separate the condensed water formed on the lower surface of the evaporator 1 so as to move the condensed water into the drain part formed in the housing 4.

Figure 7:
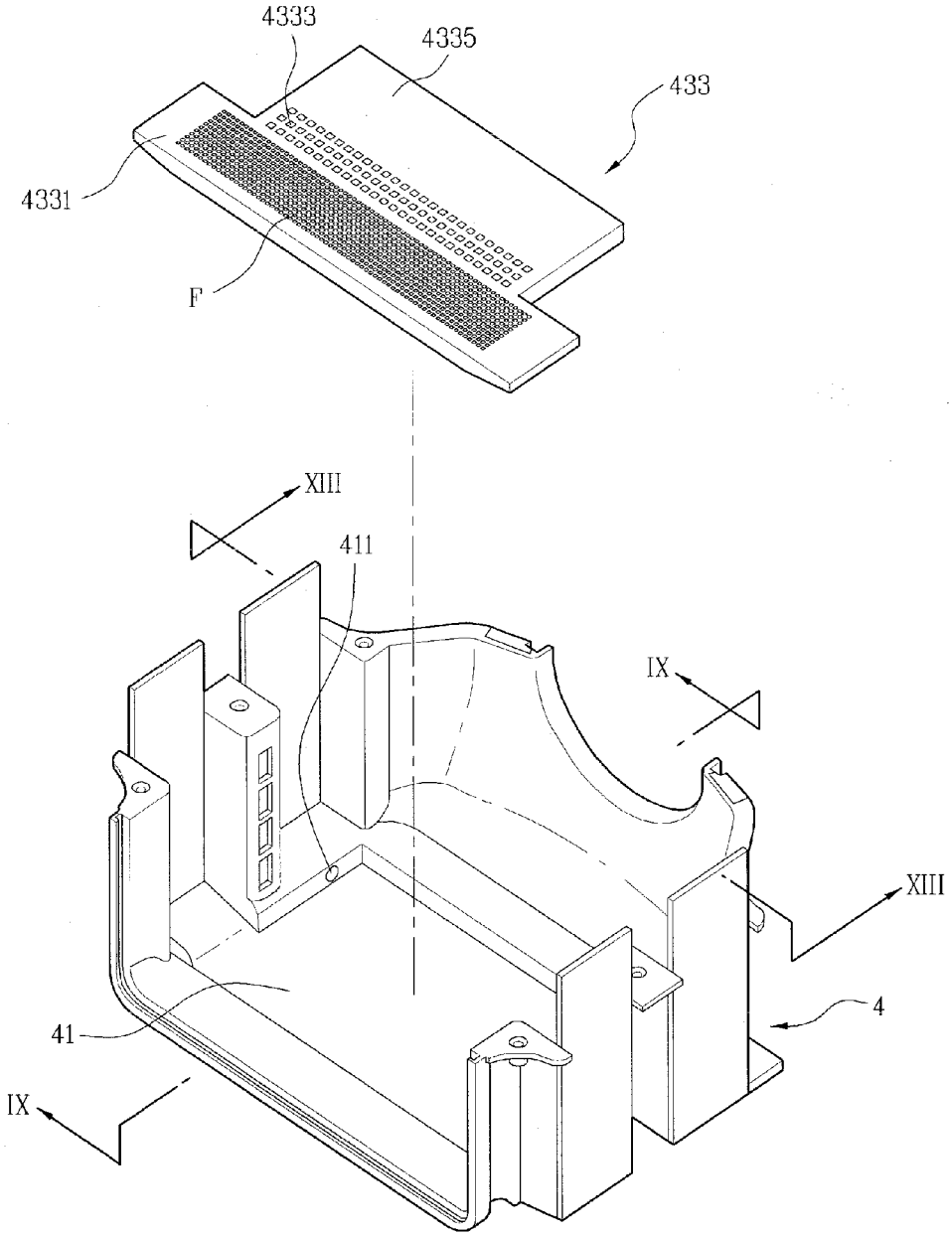
FIG. 7 is an exploded perspective view of FIG. 6.

To solve the above described problem, the housing 4 provided in the heat pump module 100' according to this embodiment may include the condensed water reservoir 41 and a condensed water guide in the form of a guide plate 433. Hereinafter, the condensed water reservoir 41 and the condensed water guide in the form of the guide plate 433 according to this embodiment will be described in more detail with reference to FIGS. 6-7. FIG. 6 is a perspective view of a housing according to another embodiment. FIG. 7 is an exploded perspective view of FIG. 6.

The condensed water reservoir 41 of the housing 4 may be indented or extend from a lower surface of the condenser 2, as well as the lower surface of the evaporator 1, and may serve to store the condensed water formed on the evaporator 1. The housing 4 may further include the drain part 411 formed in one side of the condensed water reservoir 41 to discharge the condensed water collected from the evaporator 1. Thereby, the condensed water stored in the condensed water reservoir 41 may be discharged out of the housing 4.

The bottom surface of the condensed water reservoir 41 may be inclined or slope downward toward the drain part 411 by a predetermined angle. This may serve to easily discharge the condensed water collected in the condensed water reservoir 41 out of the housing 4.

Figure 8:
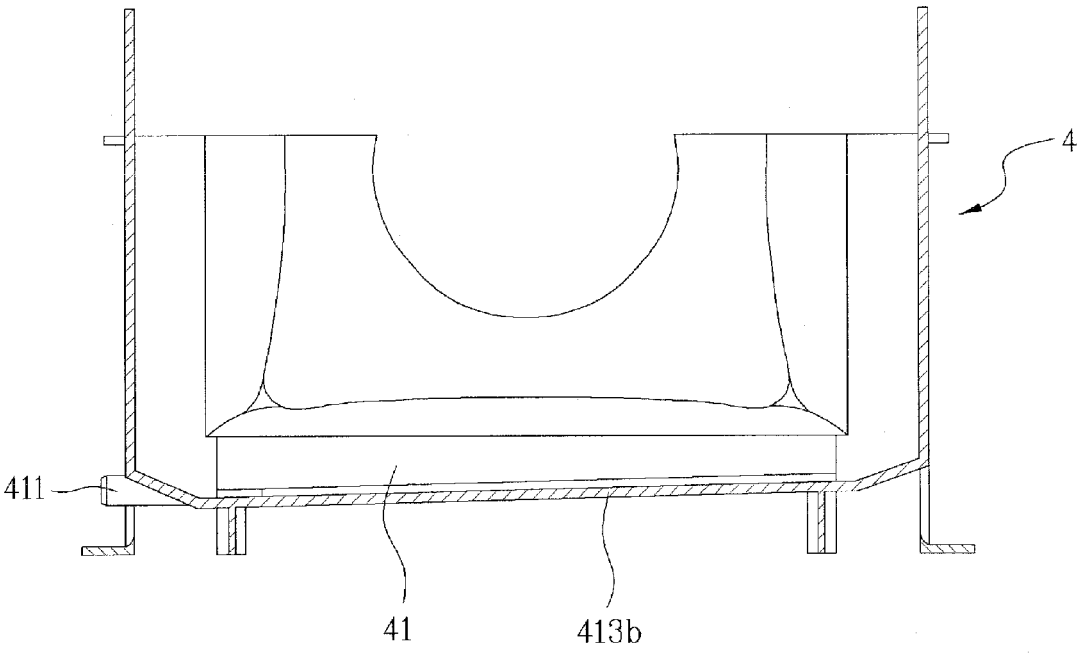
FIG. 8 is a sectional view taken along the line XIII-XIII of FIG. 7.
Figure 9:
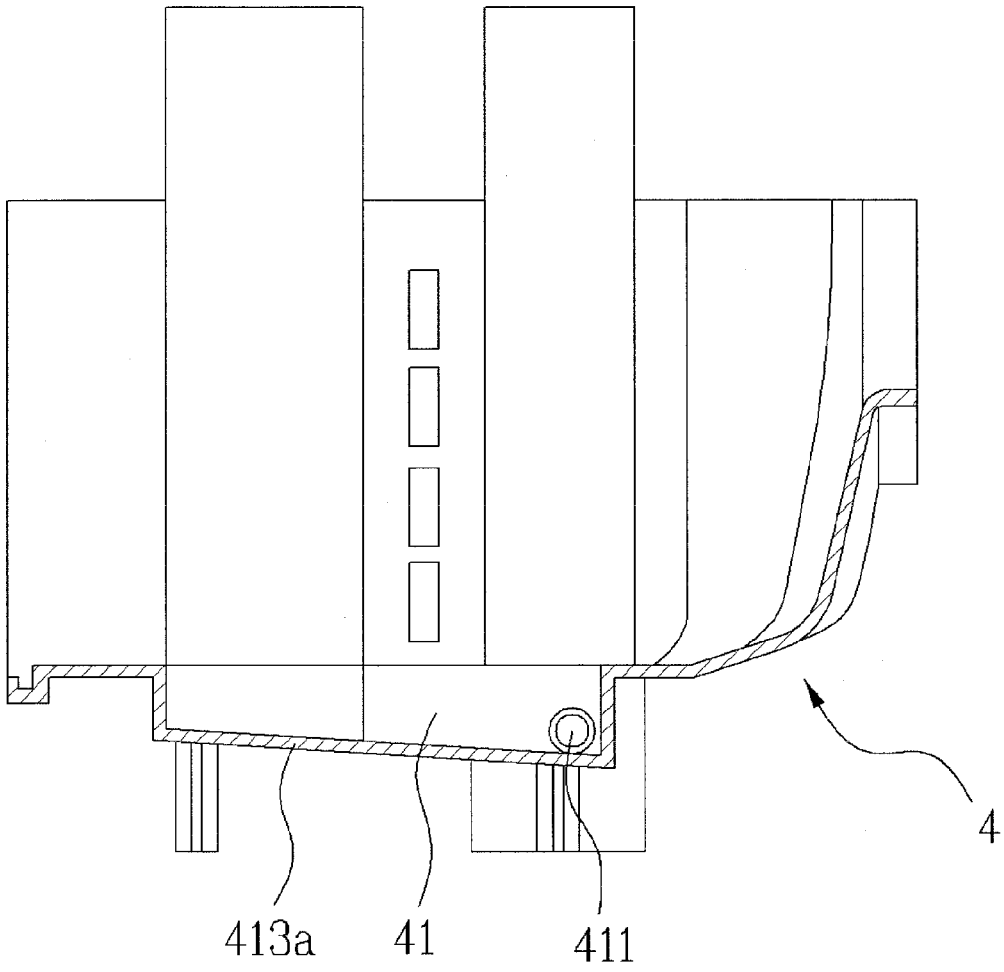
FIG. 9 is a sectional view taken along the line IX-IX of FIG. 7.

The slope defined at the condensed water reservoir 41 may be configured as shown in FIG. 9, such that the slope 413*a* extends in a longitudinal direction of the housing 4, or may be configured as shown in FIG. 8, such that the slope 413*b* extends in a transversal direction of the housing 4. Alternatively, slopes may extend in the longitudinal direction and the transversal direction of the housing 4. When the slope 413*a* and/or 413*b* are/is provided, for drainage of the condensed water, the drain part 411 may be located at a lowest position of the slope 413*a* or 413*b*.

The guide plate 433, as shown in FIG. 6, may be configured to be seated on the condensed water reservoir 41 of the housing 4 and may serve to support the evaporator 1 and the condenser 2. The guide plate 433 may include an evaporator supporting portion 4331 positioned to support the evaporator 1, a condenser supporting portion 4335 positioned to support the condenser 2, and one or more barrier hole(s) 4333 between the evaporator supporting portion 4331 and the condenser supporting portion 4335.

The evaporator supporting portion 4331 may be configured to contact the lower surface of the evaporator 1, thereby serving to support the evaporator 1. The evaporator supporting portion 4331 may include a filtering part F to remove the condensed water formed on the surface of the evaporator 1 and foreign substances contained in the condensed water. The filtering part F may include a plurality of holes (filtering holes) perforated in the evaporator supporting portion 4331. Accordingly, the filtering part F may come into contact with the evaporator 1 so as to support the evaporator 1, and also, may function to allow the condensed water formed on the surface of the evaporator 1 to be collected in the condensed water reservoir 41 located under the filtering part F.

The filtering part F may filter foreign substances contained in the air, having undergone heat exchange in the evaporator 1, when the condensed water is introduced into the condensed water reservoir 41. Accordingly, as the foreign substances contained in the air may be introduced into the condensed water reservoir 41, it may be possible to prevent the drain part 411 from being clogged by the foreign substances introduced into the condensed water reservoir 41.

The barrier hole(s) 4333 may be provided between the filtering part F and the condenser supporting portion 4335, and may take the form of one or more holes perforated in the guide plate 433. This configuration may serve to prevent the condensed water removed from the evaporator 1 from entering the condenser 2 rather than being introduced into the condensed water reservoir 41 through the filtering part F.

The barrier hole(s) 4333 may be formed in an intermediate region of the guide plate 433 between the evaporator 1 and the condenser 2, and may have a larger diameter than a diameter of the plurality of holes of the filtering part F. The condenser supporting portion 4335 capable of supporting the condenser 2 may be arranged next to the barrier holes 4333.

Hereinafter, operational relationships of the constituent elements of the heat pump module 100' according to this embodiment will be described. Referring to FIG. 5, if the heat pump module 100' is operated for the purpose of drying air, the fan 3 may be operated, causing air to be introduced into the housing 4 through the inlet duct 45. When the air introduced into the housing 4 undergoes heat exchange in the evaporator 1, the air may be deprived of moisture, causing condensed water to be formed on the surface of the evaporator 1. The condensed water formed on the surface of the evaporator 1 may be collected in the condensed water reservoir 41 through the filtering part F of the guide plate 433 that comes into contact with the lower surface of the evaporator 1.

In this case, since the foreign substances, which have been introduced into the housing 4 along with the air and have been adsorbed in the condensed water, are filtered by the filtering part F, it may be possible to prevent the drain part 411 from being clogged by the foreign substances. In addition, the barrier hole(s) 4333 may prevent the condensed water removed from the surface of the evaporator 1 from being introduced into the condenser 2. Accordingly, it may be possible to prevent deterioration in the efficiency of the condenser 2 due to the condensed water.

The condensed water introduced into the condensed water reservoir 41 may be moved toward the drain part 411 of the housing 4 along the slope 413*a* and/or 413*b* of FIG. 8 or FIG. 9, thereby being discharged out of the housing 4 through the drain part 411.

As will be appreciated from FIG. 5, under operation of the fan 3, the heat-exchanged air having passed through the evaporator 1 may be introduced into the condenser 2 and then, may be discharged out of the heat pump module 100' through the outlet duct 47 after being heated.

Figure 10:
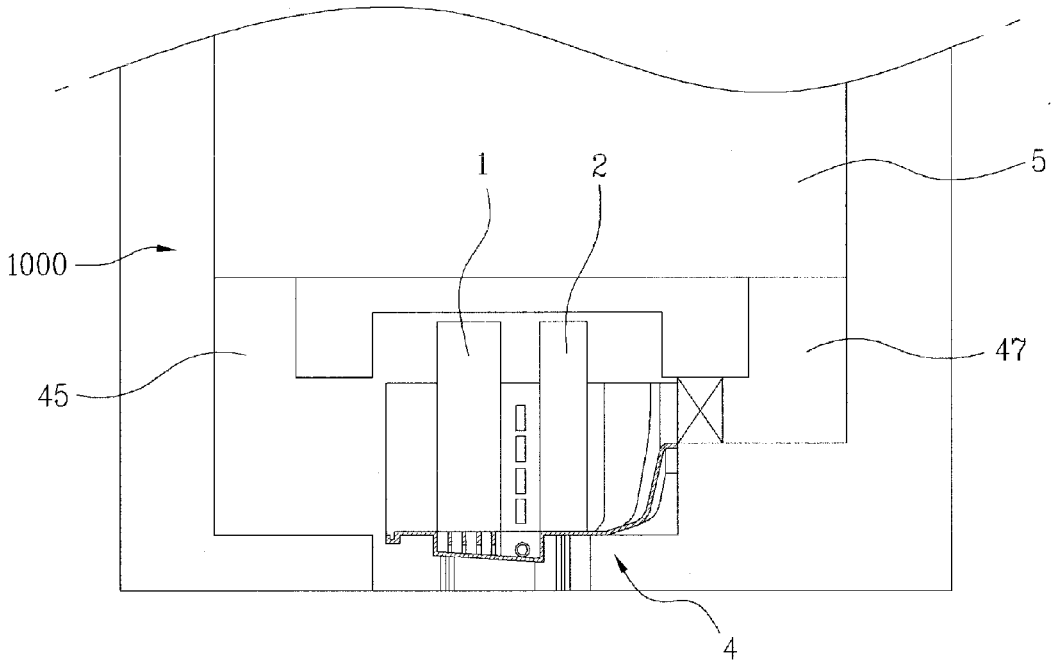
FIG. 10 is a conceptual view of a drying apparatus including the heat pump module of FIG. 1.
Figure 11:
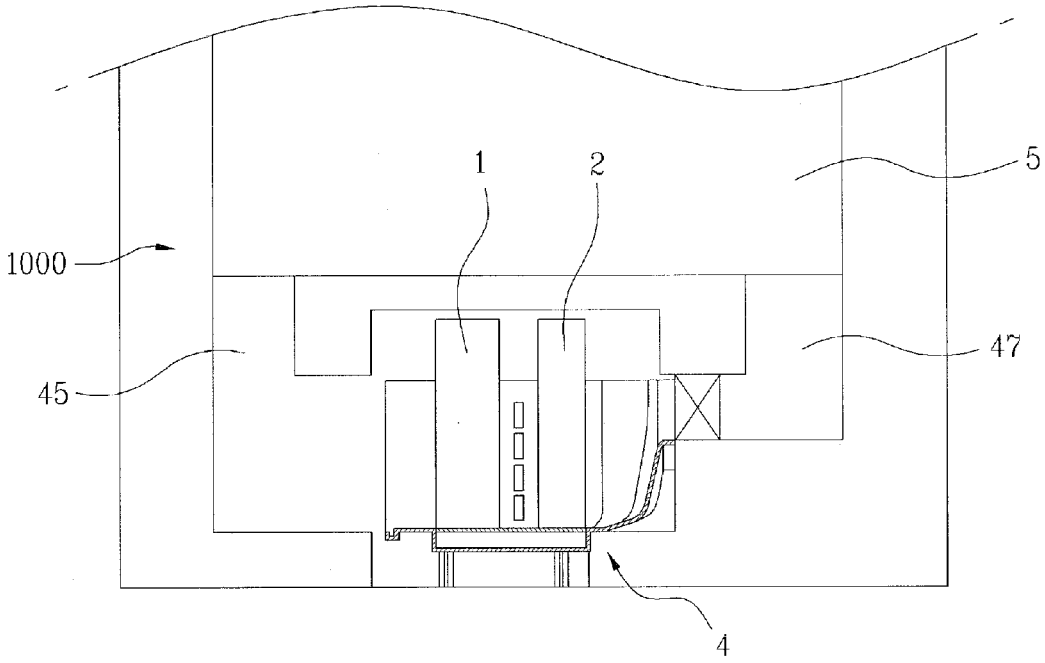
FIG. 11 is a conceptual view of a drying apparatus including the heat pump module of FIG. 5.

FIGS. 10 and 11 are conceptual views of a drying apparatus 1000 including the heat pump module 100 or 100' shown in FIG. 1 or FIG. 5. The drying apparatus 1000 according to embodiments may include a drying space 5 configured to receive and dry laundry therein, with the above described heat pump module being arranged in or adjacent to the drying space 5. In the drying apparatus 1000, the drying space 5 may be connected, at one side thereof, to the inlet duct 45 and, at the other side thereof, to the outlet duct 47.

Accordingly, the interior air of the drying space 5 may be introduced into the housing 4 through the inlet duct 45 and may undergo heat exchange in the heat pump module 100 or 100' shown in FIG. 1 or FIG. 5. The heat-exchanged high-temperature dry air may be introduced into the drying space 5 through the outlet duct 47, thereby serving to dry the laundry received in the drying space 5.

Alternatively, instead of arranging the heat pump module 100 or 100' in the interior of the drying space 5, the heat pump module 100 or 100' may be placed in a separate space. Arranging the heat pump module 100 or 100' within the drying apparatus 1000 to utilize any interior space close to the drying space 5 serves to prevent increase in the overall size of the drying apparatus 1000.

In the case where the heat pump module is placed in a separate space, the separate place may take the form of a drawer, so as to be pulled forward out of the drying apparatus 1000. If the heat pump module 100 or 100' malfunctions, the separate space may be pulled forward out of the drying apparatus 1000, enabling easy inspection of the heat pump module 100 or 100' and resulting in compact size of the drying apparatus 1000.

In this case, the inlet duct 43 and the outlet duct 47 may further include flexible tubes to assure communication with the drying space 5, even in the case where the separate space is pulled forward out of the drying apparatus 1000. This serves to prevent disconnection between the heat pump module 100 or 100' and the drying space 5 when the separate space, in which the heat pump module 100 or 100' is received, is pulled forward out of the drying apparatus 1000 or is pushed into the drying apparatus 1000. However, it is noted that another configuration for separating or connecting the inlet duct 45 and the outlet duct 47 from or to the drying space 5 when the separate space is pulled forward out of the drying apparatus or is pushed into the drying apparatus 1000 may be adopted.

Embodiments disclosed herein are directed to a heat pump module and a drying apparatus using the heat pump module that substantially obviate one or more problems due to limitations and disadvantages of the related art. That is, embodiments disclosed herein provide a heat pump module for drying clothes and a drying apparatus having the same. Further, embodiments disclosed herein provide a heat pump module capable of easily removing condensed water formed on a surface of an evaporator and a drying apparatus having the heat pump module. Additionally, embodiments disclosed herein provide a heat pump module capable of easily discharging condensed water collected from an evaporator and a drying apparatus having the heat pump module.

Embodiments, as embodied and broadly described herein, may include a heat pump module comprising a housing, an evaporator provided in the housing that serves to condense air introduced into the housing via evaporation of refrigerant, a condenser provided in the housing that serves to heat the air having passed through the evaporator via condensation of the refrigerant, and a condensed water remover or guide provided in the housing that serves to remove condensed water generated on a surface of the evaporator therefrom while coming into contact with a lower surface of the evaporator.

The housing may further include a condensed water reservoir indented or extended from the lower surface of the evaporator to store the condensed water removed via the condensed water remover. The condensed water remover may take the form of a condensed water guide vertically extending between a bottom surface of the condensed water reservoir and the lower surface of the evaporator.

The housing may further include a drain part to discharge the condensed water, stored in the condensed water reservoir, out of the housing. The condensed water guide may include a communication part to allow the condensed water to be movable to the drain part.

The heat pump module may further include a condensed water reservoir provided in the housing and indented from the lower surface of the evaporator and a lower surface of the condenser, the condensed water reservoir serving to store the condensed water removed via the condensed water remover. The condensed water remover may take the form of a guide plate located above the condensed water reservoir to come into contact with the lower surface of the evaporator and the lower surface of the condenser.

The guide plate may include a filtering part to filter foreign substances contained in the condensed water and to allow the condensed water, from which the foreign substances have been filtered, to be collected in the condensed water reservoir. The filtering part may be positioned only at a region of the guide plate which comes into contact with the lower surface of the evaporator.

The guide plate may further include a barrier hole positioned between the evaporator and the condenser and serving to prevent the condensed water from coming into contact with the condenser. The filtering part may include a filtering hole, and the barrier hole may have a larger diameter than a diameter of the filtering hole.

In accordance with another embodiment, a drying apparatus may be provided which may include a drying space, in which laundry is dried, a housing that communicates with the drying space, an evaporator provided in the housing that serves to condense highly humid air introduced from the drying space into the housing via evaporation of refrigerant, a condenser provided in the housing that serves to heat the air having passed through the evaporator via condensation of the refrigerant, a fan provided in the housing that serves to introduce the air having passed through the condenser into the drying space, and a condensed water remover provided in the housing that serves to remove condensed water generated on a surface of the evaporator therefrom while coming into contact with a lower surface of the evaporator.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heat pump module comprising; a housing; an evaporator provided in the housing that condenses air, introduced into the housing, via evaporation of a refrigerant; and a condenser provided in the housing that heats the air, having passed through the evaporator, via condensation of the refrigerant, wherein the housing includes:

a. a condensed water reservoir indented from a lower surface of the evaporator and a lower surface of the condenser to store condensed water b. a drain part that discharges the condensed water, stored in the condensed water reservoir, out of the housing; and c. a guide plate located above the condensed water reservoir in contact with the lower surface of the evaporator and the lower surface of the condenser, wherein the guide plate includes:

i. an evaporator supporting portion configured to support the lower surface of the evaporator;

ii. a condenser supporting portion configured to support the lower surface of the condenser iii. at least one filtering hole provided in the evaporator supporting portion to filter foreign substances contained in the condensed water and allow the condensed water, from which the foreign substances have been filtered, to be collected in the condensed water reservoir; and iv. at least one barrier hole having a larger diameter than a diameter of the at least one filtering hole and positioned between the evaporator supporting portion and the condenser supporting portion that prevents the condensed water from coming into contact with the condenser.

2. The heat pump module of claim 1, wherein the guide plate is formed separate from the housing.

3. The heat pump module according to claim 1, wherein the at least one filtering hole is positioned only at a region of the guide plate that contacts the lower surface of the evaporator.

4. A drying apparatus, comprising: a drying space, in which laundry is dried; a housing in communication with the drying space; an evaporator provided in the housing that condenses air introduced from the drying space into the housing via evaporation of a refrigerant; a condenser provided in the housing that heats the air, having passed through the evaporator, via condensation of the refrigerant; and a fan provided in the housing that introduces the air, having passed through the condenser, into the drying space, wherein the housing includes:

d. a condensed water reservoir indented from a lower surface of the evaporator and a lower surface of the condenser to store condensed water;

e. a drain part that discharges the condensed water, stored in the condensed water reservoir, out of the housing; and f. a guide plate located above the condensed water reservoir in contact with the lower surface of the evaporator and the lower surface of the condenser, wherein the guide plate includes:

v. an evaporator supporting portion configured to support the lower surface of the evaporator;

vi. a condenser supporting portion configured to support the lower surface of the condenser;

vii. at least one filtering hole provided in the evaporator supporting portion to filter foreign substances contained in the condensed water and allow the condensed water, from which the foreign substances have been filtered, to be collected in the condensed water reservoir; and viii. at least one barrier hole having a larger diameter than a diameter of the at least one filtering hole and positioned between the evaporator supporting portion and the condenser supporting portion that prevents the condensed water from coming into contact with the condenser.

5. The drying apparatus according claim 4, wherein the at least one filtering hole is positioned only at a region of the guide plate that contacts the lower surface of the evaporator.

* * * * *